US011335284B2

(12) United States Patent
Wang et al.

(10) Patent No.: US 11,335,284 B2
(45) Date of Patent: May 17, 2022

(54) DISPLAY PANEL AND DISPLAY DEVICE

(71) Applicant: Xiamen Tianma Micro-Electronics Co., Ltd., Xiamen (CN)

(72) Inventors: Hailiang Wang, Xiamen (CN); Yaqiong Long, Xiamen (CN); Yan Lin, Shanghai (CN); Yan Yang, Xiamen (CN); Ting Zhou, Xiamen (CN); Junyi Li, Xiamen (CN)

(73) Assignee: Xiamen Tianma Micro-Electronics Co., Ltd., Xiamen (CN)

( * ) Notice: Subject to any disclaimer, the term of this patent is extended or adjusted under 35 U.S.C. 154(b) by 100 days.

(21) Appl. No.: 16/991,239

(22) Filed: Aug. 12, 2020

(65) Prior Publication Data

US 2021/0407445 A1 Dec. 30, 2021

(30) Foreign Application Priority Data

Jun. 30, 2020 (CN) ..... 202010623020.X

(51) Int. Cl.
*G09G 3/36* (2006.01)

(52) U.S. Cl.
CPC ..... *G09G 3/3607* (2013.01); *G09G 3/3688* (2013.01); *G09G 2300/0452* (2013.01); *G09G 2300/0804* (2013.01)

(58) Field of Classification Search
CPC ..... G09G 3/3607; G09G 3/3688; G09G 2300/0452; G09G 2300/0804
See application file for complete search history.

(56) References Cited

U.S. PATENT DOCUMENTS

2019/0108802 A1* 4/2019 Imai ..... G09G 3/2022
2019/0108806 A1* 4/2019 Kimura ..... G09G 3/3688

FOREIGN PATENT DOCUMENTS

CN 110416275 A 11/2019
CN 110416276 A 11/2019

* cited by examiner

*Primary Examiner* — Sejoon Ahn
(74) *Attorney, Agent, or Firm* — Anova Law Group, PLLC

(57) ABSTRACT

Display panel and display device are provided. The display panel includes a first display area and a second display area adjacent to the first display area. The second display area is multiplexed as a photosensitive element setting area. The first display area includes a plurality of first pixels arranged in an array. The second display area includes a plurality of second pixels arranged in an array. A first pixel of the plurality of first pixels includes a plurality of first sub-pixels. A second pixel of the plurality of second pixels includes a first area and a second area. The first area includes a plurality of second sub-pixels. The second area is in an open state when a photosensitive element is in operation. The second area is in a closed state when the display panel is in a full screen display.

19 Claims, 18 Drawing Sheets

DISPLAY PANEL AND DISPLAY DEVICE

CROSS-REFERENCES TO RELATED APPLICATIONS

This application claims priority of Chinese Patent Application No. 202010623020.X, filed on Jun. 30, 2020, the entire contents of which are hereby incorporated by reference.

FIELD OF THE DISCLOSURE

The present disclosure generally relates to the field of display technology and, more particularly, relates to a display panel and a display device.

BACKGROUND

At present, mobile phones and other electronic products may face an increasing demand for a high screen-to-body ratio. Full-screen mobile phones may cover almost 70% of the mobile phone market. The screen-to-body ratio is a ratio of a screen area to a whole device area. A mobile phone with a higher screen-to-body ratio can bring users a better visual experience.

As a front side of a mobile phone needs to be placed with a camera, a light sensor and other components, there are usually two existing solutions. One solution is to design a non-display area at a top of the screen including, widely used "notched screen", "water drop screen", and "infinity-o screen". The non-display area cannot display images. The other solution is to design a lifting camera. Although the lifting camera can achieve a full-screen display, it requires response time of a camera mechanism during shooting and the camera is unprotected. In addition, a lifting structure may be used, which may increase a thickness of the mobile phone and is not conducive to development of thin and light mobile phones.

BRIEF SUMMARY OF THE DISCLOSURE

One aspect of the present disclosure provides a display panel. The display panel includes a first display area and a second display area adjacent to the first display area. The second display area is multiplexed as a photosensitive element setting area. The first display area includes a plurality of first pixels arranged in an array. The second display area includes a plurality of second pixels arranged in an array. A first pixel of the plurality of first pixels includes a plurality of first sub-pixels. A second pixel of the plurality of second pixels includes a first area and a second area. The first area includes a plurality of second sub-pixels. An area of a first sub-pixel of the plurality of first sub-pixels is less than an area of a second sub-pixel of the plurality of second sub-pixels. An area of the first area is less than or equal to an area of the second area. The second area is in an open state when a photosensitive element is in operation. External light enters the photosensitive element through the second area. The second area is in a closed state when the display panel is in a full screen display. The plurality of second sub-pixels are configured to realize a normal display of the second display area.

Another aspect of the present disclosure provides a display device. The display device includes a display panel and a photosensitive element. The display panel includes a first display area and a second display area adjacent to the first display area. The second display area is multiplexed as a photosensitive element setting area. The first display area includes a plurality of first pixels arranged in an array. The second display area includes a plurality of second pixels arranged in an array. A first pixel of the plurality of first pixels includes a plurality of first sub-pixels. A second pixel of the plurality of second pixels includes a first area and a second area. The first area includes a plurality of second sub-pixels. An area of a first sub-pixel of the plurality of first sub-pixels is less than an area of a second sub-pixel of the plurality of second sub-pixels. An area of the first area is less than or equal to an area of the second area. The second area is in an open state when a photosensitive element is in operation. External light enters the photosensitive element through the second area. The second area is in a closed state when the display panel is in a full screen display. The plurality of second sub-pixels are configured to realize a normal display of the second display area. The photosensitive element is disposed in the second display area of the display panel and on a side away from a light emitting surface of the display panel, a photosensitive surface of the photosensitive element facing toward the display panel.

Other aspects or embodiments of the present disclosure can be understood by those skilled in the art in light of the description, the claims, and the drawings of the present disclosure.

DETAILED DESCRIPTION

Figure 1:
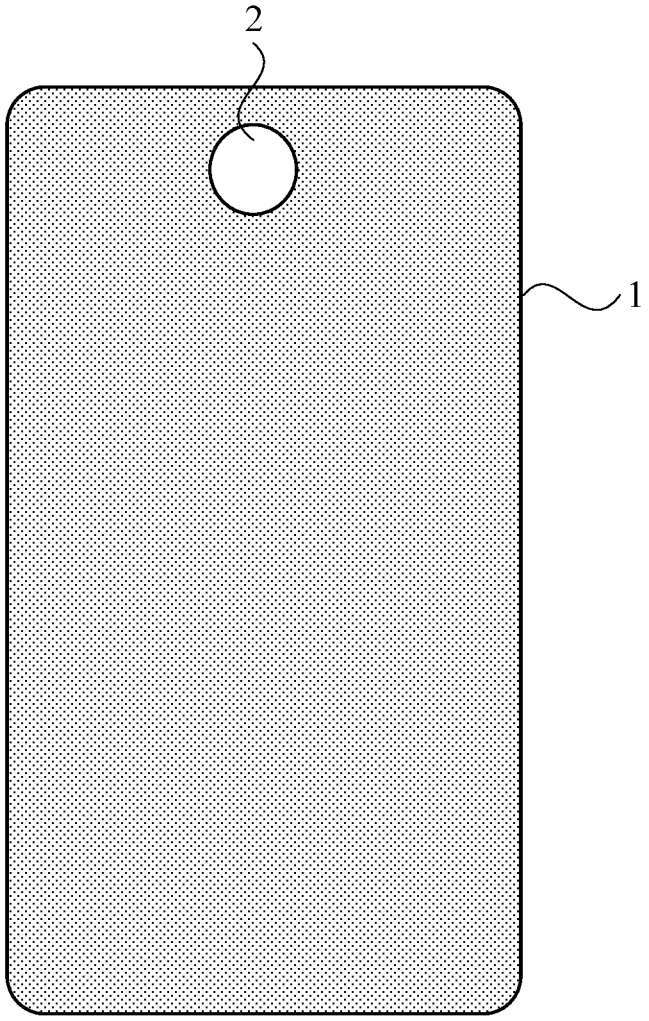
FIG. 1 illustrates a schematic diagram of a display panel.

The present disclosure is further described in detail below with reference to appending drawings and specific embodiments. It can be understood that the specific embodiments described here are only used to explain but not to limit the present disclosure. In addition, it should be noted that, for ease of description, the appending drawings only show part but not all of the structure related to the present disclosure.

The terms used in the embodiments of the present disclosure are only for the purpose of describing the embodiments but are not intended to limit the present disclosure. It should be noted that "upper", "lower", "left", "right" and other directional words described in the embodiments of the present disclosure are described from the angle shown in the drawings, and should not be construed as limiting the embodiments of the present disclosure. In addition, in the context, it should be understood that when it is mentioned that an element is formed "on" or "under" another element, it can not only be directly formed "on" or "under" another element, but also indirectly formed "on" or "under" another element through an intermediate element. The terms "first", "second", etc. are only used for descriptive purposes, and do not indicate any order, quantity or importance, but are only used to distinguish different components. For those skilled in the art, specific meanings of the above terms in the present disclosure can be understood according to specific situations.

FIG. 1 illustrates a schematic diagram of a display panel. Referring to FIG. 1, the display panel includes a display area 1 and a hole-digging area 2 arranged in the display area 1. The display area 1 is provided with pixel units arranged in an array (not shown), and there is no pixel unit in the hole-digging area 2, so that an under-screen photosensitive element such as a camera can obtain external light through the hole-digging area 2. The above setting method cannot achieve a normal display of the hole-digging area 2 and cannot achieve a true full-screen display effect.

In one embodiment, a display panel includes a first display area and a second display area adjacent to the first display area. The second display area is multiplexed as a photosensitive element setting area. The first display area includes a plurality of first pixels arranged in an array. The second display area includes a plurality of second pixels arranged in an array. A first pixel of the plurality of first pixels includes a plurality of first sub-pixels. A second pixel of the plurality of second pixels includes a first area and a second area. The first area includes a plurality of second sub-pixels. An area of a first sub-pixel of the plurality of first sub-pixels is smaller than an area of a second sub-pixel of the plurality of second sub-pixels. An area of the first area is less than or equal to an area of the second area. The second area is in an open state when a photosensitive element is in operation, and external light enters the photosensitive element through the second area. The second area is in a closed state when the display panel is in a full screen display, and the second sub-pixel is configured to realize a normal display of the second display area.

Figure 2:
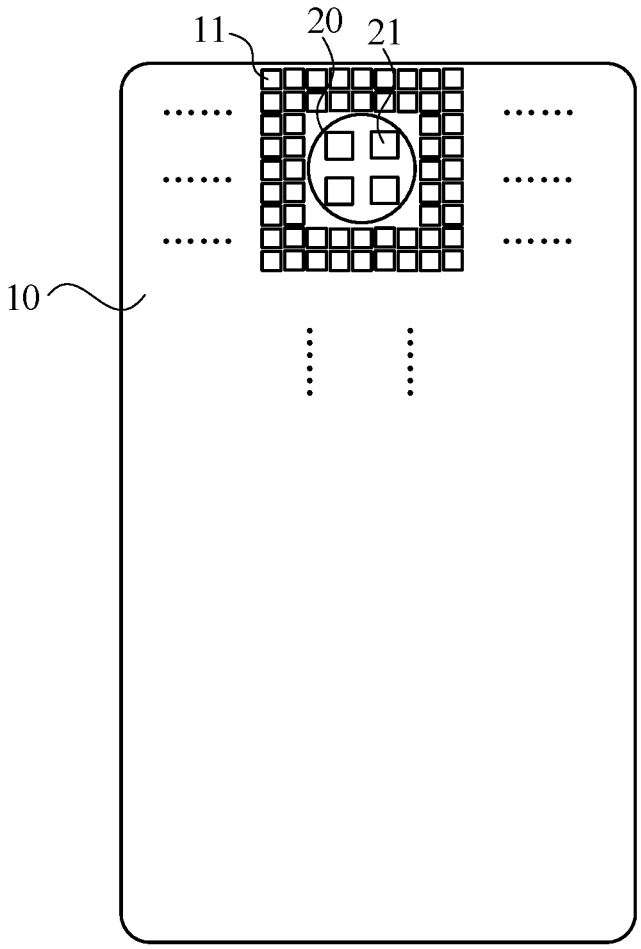
FIG. 2 illustrates a schematic diagram of an exemplary display panel consistent with various disclosed embodiments of the present disclosure.
Figure 3:
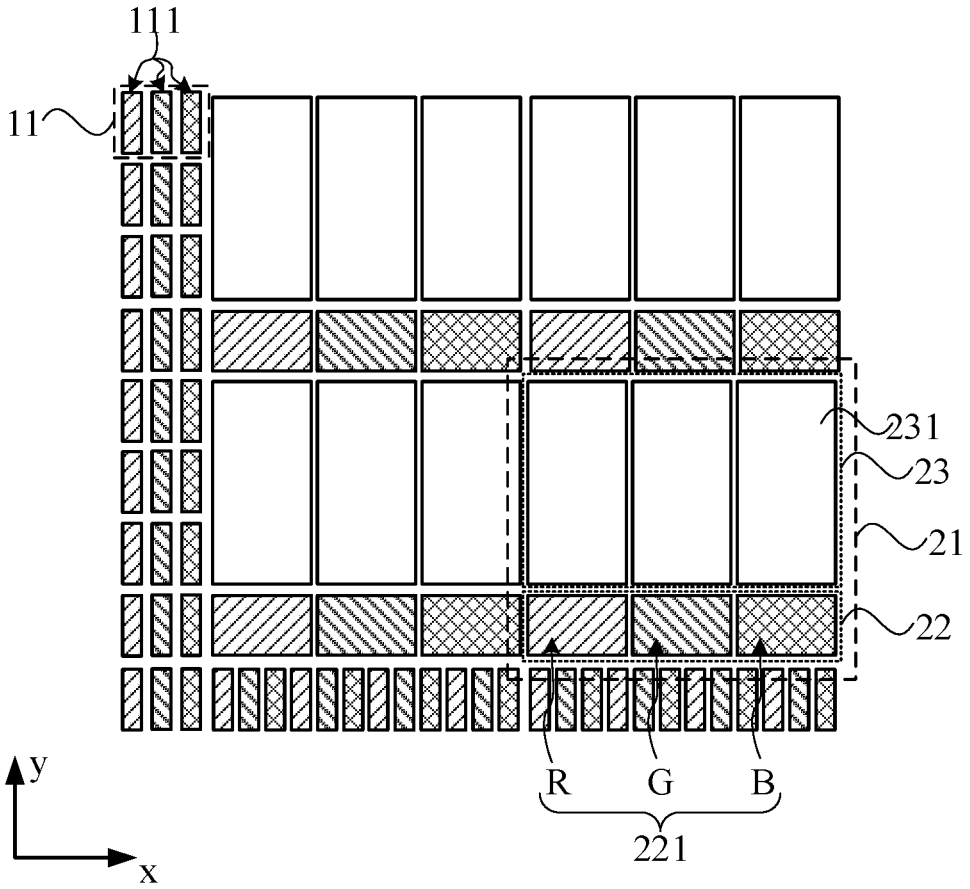
FIG. 3 illustrates a partial schematic diagram of an exemplary display panel consistent with various disclosed embodiments of the present disclosure.

FIG. 2 illustrates a schematic diagram of an exemplary display panel consistent with various disclosed embodiments of the present disclosure, and FIG. 3 illustrates a partial schematic diagram of an exemplary display panel consistent with various disclosed embodiments of the present disclosure. Referring to FIG. 2, in one embodiment, the display panel includes a first display area 10 and a second display area 20 adjacent to the first display area 10. The second display area 20 is multiplexed as a photosensitive element setting area. The first display area 10 includes a plurality of first pixels 11 arranged in an array. The second display area 20 includes a plurality of second pixels 21 arranged in an array. Referring to FIG. 3, a first pixel of the plurality of first pixels 11 includes a plurality of first sub-pixels 111, and a second pixel 21 includes a first area 22 and a second area 23. The first area 22 includes a plurality of second sub-pixels 221. An area of a first sub-pixel of the plurality of first sub-pixels 111 is smaller than an area of a second sub-pixel of the plurality of second sub-pixels 221. An area of the first area 22 is smaller than an area of the second area 23. In other embodiments, an area of the first area 22 may be set equal to an area of the second area 23, which is not limited herein. The display panel may be a liquid crystal display panel. A light source is provided through a backlight module. The liquid crystal display panel includes a color filter (CF) substrate, a thin film transistor (TFT) array substrate, and a liquid crystal layer between the CF substrate and the TFT array substrate. A working principle of the display panel is to control rotation of liquid crystal molecules in the liquid crystal layer by applying a driving voltage. The light source provided by the backlight module passes through the TFT array substrate of the liquid crystal display panel, refracts from the liquid crystal layer of the liquid crystal display panel, and produces color images through the CF substrate. The second area 23 may be an area where no color filter is provided and is in an open state when a photosensitive element is in operation. The open state means that the second area 23 is in a light-transmitting state, and external light enters a photosensitive element through the second area 23. The second area 23 is in a closed state when the display panel in a full screen display. The closed state means that the second area 23 is in an opaque state, and the plurality of second sub-pixels 221 are configured to realize a normal display of the second display area.

In one embodiment, the display panel is suitable for display devices that require photosensitive elements under the screen. A photosensitive element can be a camera, a plurality of cameras, or any suitable elements. For illustrative purposes, following embodiments all take a camera as an example of the photosensitive element. Due to high light requirements of the camera, the existing technology generally sets a hollowed-out area at an edge or inside of the display area. The hollowed-out area cannot be displayed and is difficult to realize a true full-screen design. Since an aperture of the camera to receive light is generally set to be circular, FIG. 2 exemplarily illustrates that the second display area 20 is a circular area. In a specific implementation process, number of second display areas 20 may be one or more. The second display area 20 may be a continuous area or a discontinuous area, which can be designed and determined according to an actual application environment and is not limited herein. In some implementations, a relative positional relationship between the first display area 10 and the second display area 20 may be such that at least part of edges of the second display area 20 overlap with at least part of edges of the first display area 10, and rest edges of the second display area 20 is surrounded by the first display area 10. Therefore, the second display area 20 can be arranged at an edge of the display area of the display panel. In other implementation processes, the relative positional relationship between the first display area 10 and the second display area 20 can also be such that the first display area 10 surrounds the second display area 20. Therefore, the second display area 20 can be arranged inside the display area of the display panel, as shown in FIG. 2. For example, the second display area 20 can be arranged at an upper left or upper right corner of the first display area 10. For another example, the second display area 20 may be arranged on a left side or a right side of the first display area 10. In actual applications, a specific location of the second display area 20 can be designed and determined according to an actual application environment, which is not limited herein.

In a specific implementation process, a shape of the second display area 20 can be set to a regular shape such as a rectangle. A top corner of the rectangle can be a right angle or an arc-shaped corner. The shape of the second display area 20 can also be set to a trapezoid. The trapezoid can be a regular trapezoid or an inverted trapezoid. A top angle of the trapezoid can be a regular angle or an arc angle. The shape of the second display area 20 can also be set to an irregular shape such as a drop shape. In practical applications, the shape of the second display area 20 can be designed according to shapes of elements arranged in the second display area 20, which is not limited herein.

In a specific implementation process, an area of the second display area 20 is smaller than an area of the first display area 10. In practical applications, the second display area 20 can be designed according to elements arranged in the second display area 20, which is not limited herein.

A relative positional relationship and shape of the first display area 10 and the second display area 20 are not limited and can be specifically set according to a screen design of a display device. Taking a mobile phone as an example, the second display area 20 can be set in an upper left corner of the display area, or the second display area 20 can be set in an upper right corner of the display area. By setting a camera in a corner, the second display area 20 may be configured to display time, weather, information reminders and other simple and quick function services.

Referring to FIG. 3, the second display area includes a plurality of second pixels 21. During a normal display, the plurality of second sub-pixels 221 in the plurality of second pixels 21 emit light to realize the normal display. To make a light transmittance of the second display area meet imaging requirements of a camera, a pixel density (Pixel Per Inch, PPI) of the second display area is less than a pixel density of the first display area. By setting an area of the second sub-pixel 221 to be larger than an area of the first sub-pixel 111, display brightness of the second display area can be improved. Optionally, an area of the second sub-pixel 221 is a same as an area of n first sub-pixels 111, and n is an integer greater than or equal to 2. An area of the second sub-pixel 221 in FIG. 3 is a same as an area of the four first sub-pixels 111, which is merely illustrative, and is not a limitation to the embodiments of the present disclosure. When the camera is configured to capture images, display functions of the second display area can be turned off to reduce brightness of ambient light around the camera during shooting and to improve shooting effect. In other embodiments, when an ambient light intensity is sufficiently bright, the display functions of the second display area may also be turned on during shooting. That is, when the camera is in operation, the second display area can be in a display state or in a closed state.

According to technical solutions of the embodiments of the present disclosure, by arranging a plurality of second pixels in an array in the second display area, a normal display of the second display area is realized, a screen-to-body ratio of the display panel is increased, and a full-screen display is realized. By setting the second area in the plurality of second pixels, the second area is in an open state when a photosensitive element (such as a camera) is in operation, and can transmit external light, thereby being received by the photosensitive element. When the display panel is normally displayed, the second area is in a closed state to avoid affecting display of the second display area, thereby taking into account a normal display and transmittance of the second display area, and increasing screen-to-body ratio of the display panel.

Optionally, continuing to refer to FIG. 3, the plurality of second sub-pixels 221 include red sub-pixels R, green sub-pixels G, and blue sub-pixels B. The second area 23 includes a plurality of first sub-areas 231 corresponding to the plurality of second sub-pixels 221 in a one-to-one correspondence. Along a first direction x, the red sub-pixels R, the green sub-pixels G, and the blue sub-pixels B are arranged repeatedly in sequence. Along a second direction y interacting the first direction x, the plurality of second sub-pixels 221 and the plurality of first sub-areas 231 are alternately arranged.

In one embodiment, a first direction x perpendicular to a second direction y is taken as an example. In the following, the first direction x is a row direction of a pixel array, and the second direction y is a column direction of the pixel array. The display panel may be a liquid crystal display panel. Red sub-pixels R, green sub-pixels G, and blue sub-pixels B can be formed by a red filter, a green filter, and a blue filter respectively. Optionally, the second area 23 includes white sub-pixels. Each of the plurality of first sub-areas 231 in FIG. 3 forms a white sub-pixel W. The white sub-pixel W does not have a filter and includes two states of on and off. The white sub-pixel W is in a transparent state when it is turned on and is in an opaque state when it is turned off. A PPI of the second display area can be set between 100 and 200. Each second pixel 21 includes one red sub-pixel R, one green sub-pixel G, one blue sub-pixel B, and three white sub-pixels W. Optionally, an area ratio of the second area to the first area is greater than or equal to 2, and less than or equal to 4. That is, an area ratio of R/G/B and W can be between 1:2 and 1:4 and can be set according to an actual situation in a specific implementation.

Figure 4:
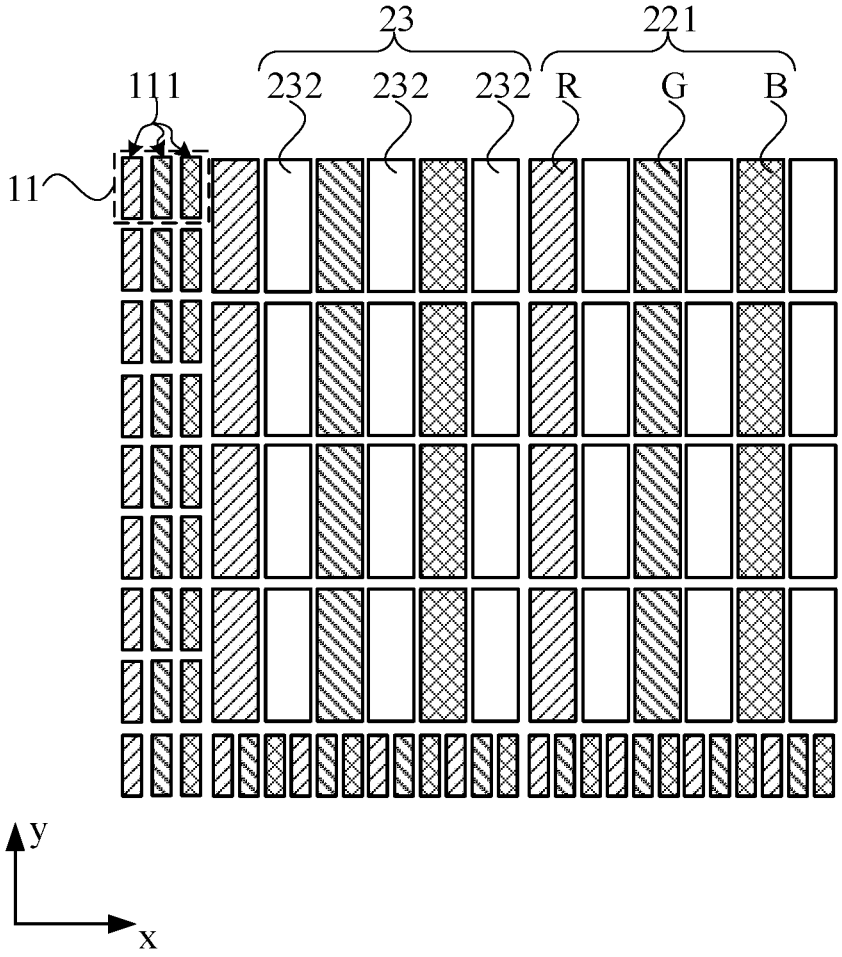
FIG. 4 illustrates a partial schematic diagram of another exemplary display panel consistent with various disclosed embodiments of the present disclosure.

Based on similar design ideas, the second display area can be designed in other pixel settings. Exemplarily, FIG. 4 illustrates a partial schematic diagram of another exemplary display panel consistent with various disclosed embodiments of the present disclosure. Referring to FIG. 4, optionally, the plurality of second sub-pixels 221 include red sub-pixels R, green sub-pixels G, and blue sub-pixels B. The second area 23 includes a plurality of second sub-areas 232 corresponding to the plurality of second sub-pixels 221 in a one-to-one correspondence. Along a first direction x, the red sub-pixels R, the green sub-pixels G, and the blue sub-pixels B are repeatedly arranged in sequence. The plurality of second sub-pixels 221 and the plurality of second sub-areas 232 are arranged at intervals in sequence. Along a second direction y interacting the first direction x, lights emitted by the second sub-pixel 221 have a same color.

In one embodiment, each second sub-area 232 forms a white sub-pixel W, and a circular setting of RGWWBW is formed along the first direction x. In the setting, there is a white sub-pixel W between every two color sub-pixels (R, G, B), which is equivalent to a setting of RGB striped pixels arranged in sequence. A display can be more uniform. In other embodiments, there may be more pixel settings. For example, along the first direction x, it may be RGWBW circular setting, RGWWB circular setting, RWGBW circular setting, RWGB circular setting, RGWB circular setting, etc.

Each second sub-pixel 221 shown in FIG. 4 has a same size as a second sub-area 232. Width and length of the second sub-pixel 221 are respectively twice width and length of the first sub-pixel 111, which is merely illustrative. A size of the second sub-pixel 221 and a size of the second sub-area 232 can be designed according to actual needs.

Figure 5:
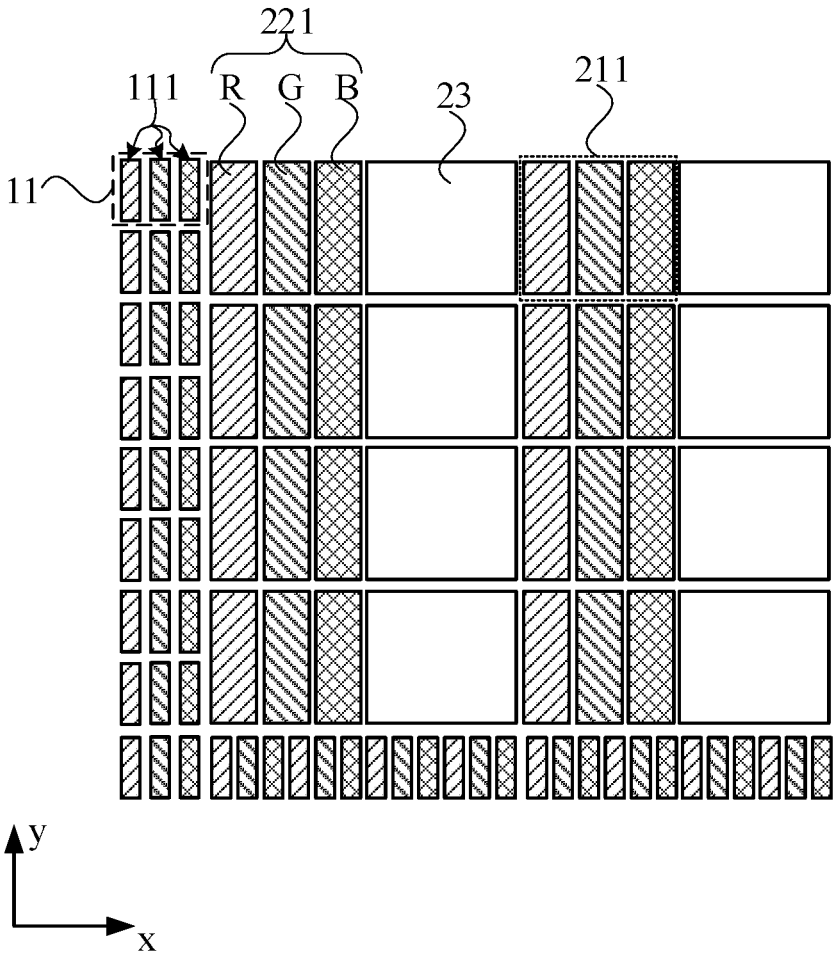
FIG. 5 illustrates a partial schematic diagram of another exemplary display panel consistent with various disclosed embodiments of the present disclosure.

FIG. 5 illustrates a partial schematic diagram of another exemplary display panel consistent with various disclosed embodiments of the present disclosure. Referring to FIG. 5, optionally, the plurality of second sub-pixels 221 include red sub-pixels R, green sub-pixels G, and blue sub-pixels B. Along a first direction x, the red sub-pixels R, the green sub-pixels G, and the blue sub-pixels B are repeatedly arranged in sequence. Red sub-pixels R, green sub-pixels G, and blue sub-pixels B in a same second pixel form a sub-pixel unit 211. The sub-pixel unit 211 and the second area 23 are alternately arranged. Along a second direction y interacting the first direction x, lights emitted by the second sub-pixel 221 have a same color.

A pixel setting shown in FIG. 5 forms a pixel setting of RGBW circularly arranged along the first direction x. The setting can make white sub-pixels W more concentrated, which is conducive to transmission of external light.

Optionally, second sub-pixels include red sub-pixels, green sub-pixels, and blue sub-pixels. In two adjacently arranged second pixels, positions of first areas in the two adjacently arranged second pixels are different.

Figure 6:
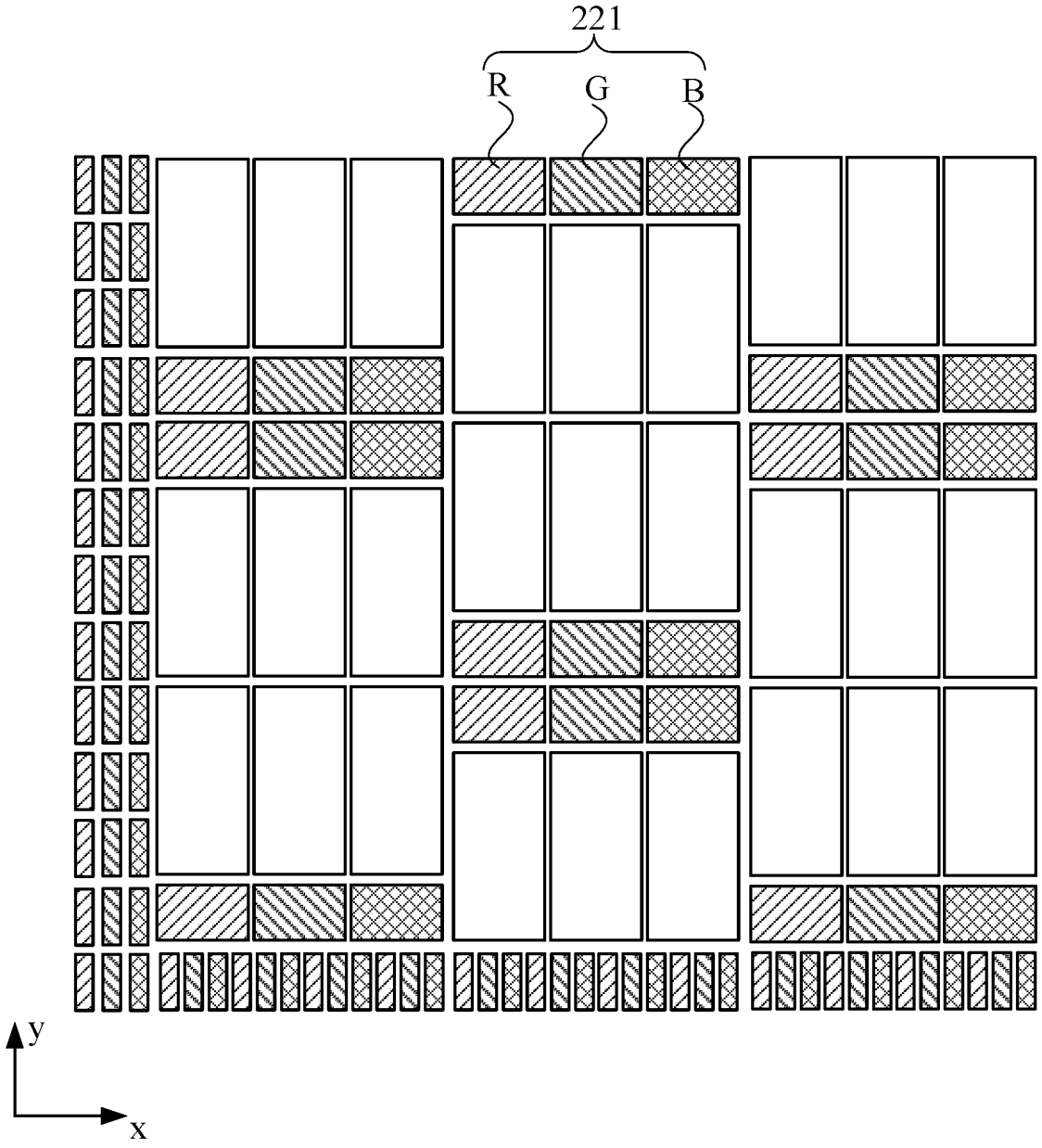
FIGS. 6-8 illustrate partial schematic diagrams of another exemplary display panel consistent with various disclosed embodiments of the present disclosure.
Figure 7:
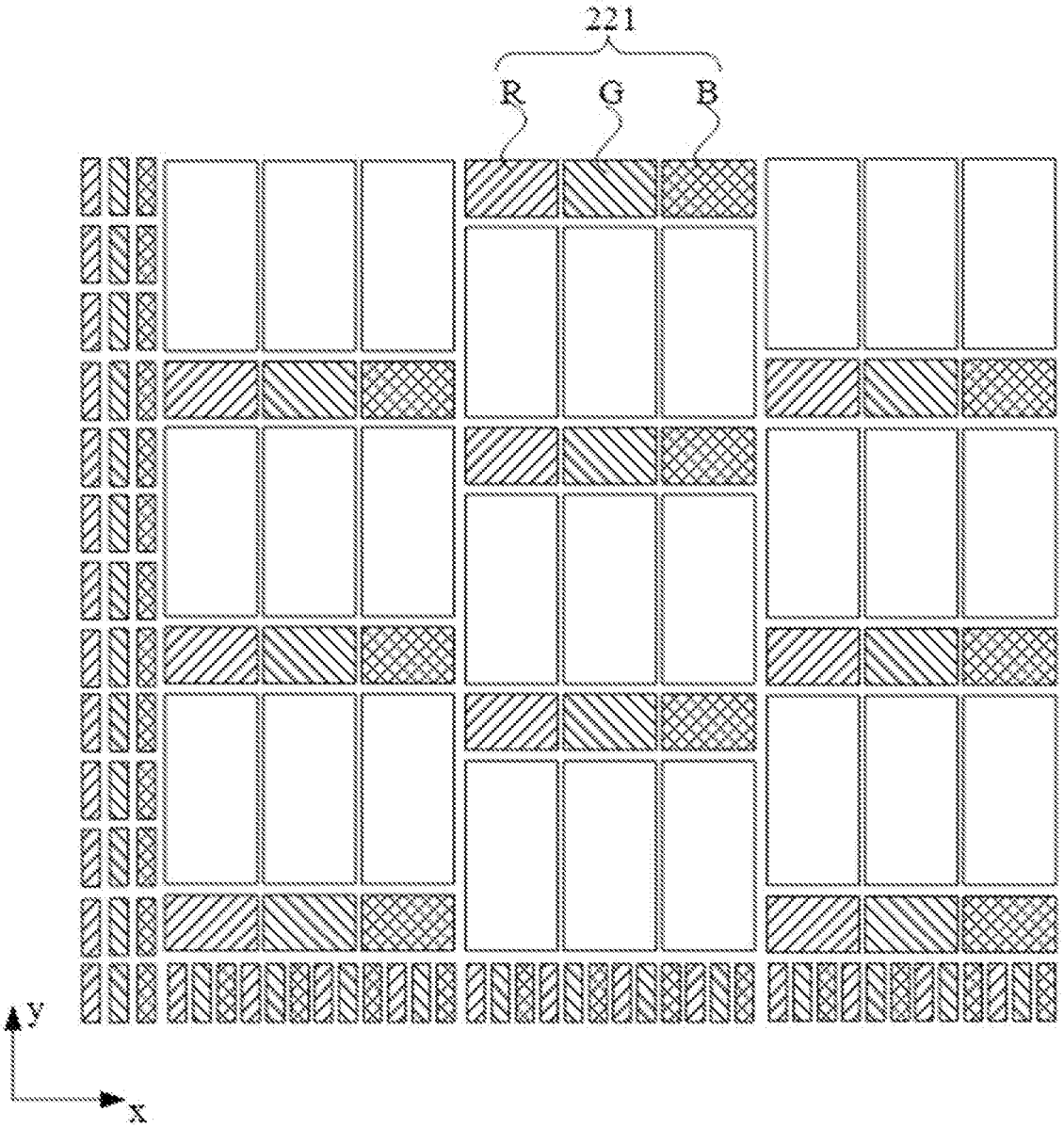
Figure 8:
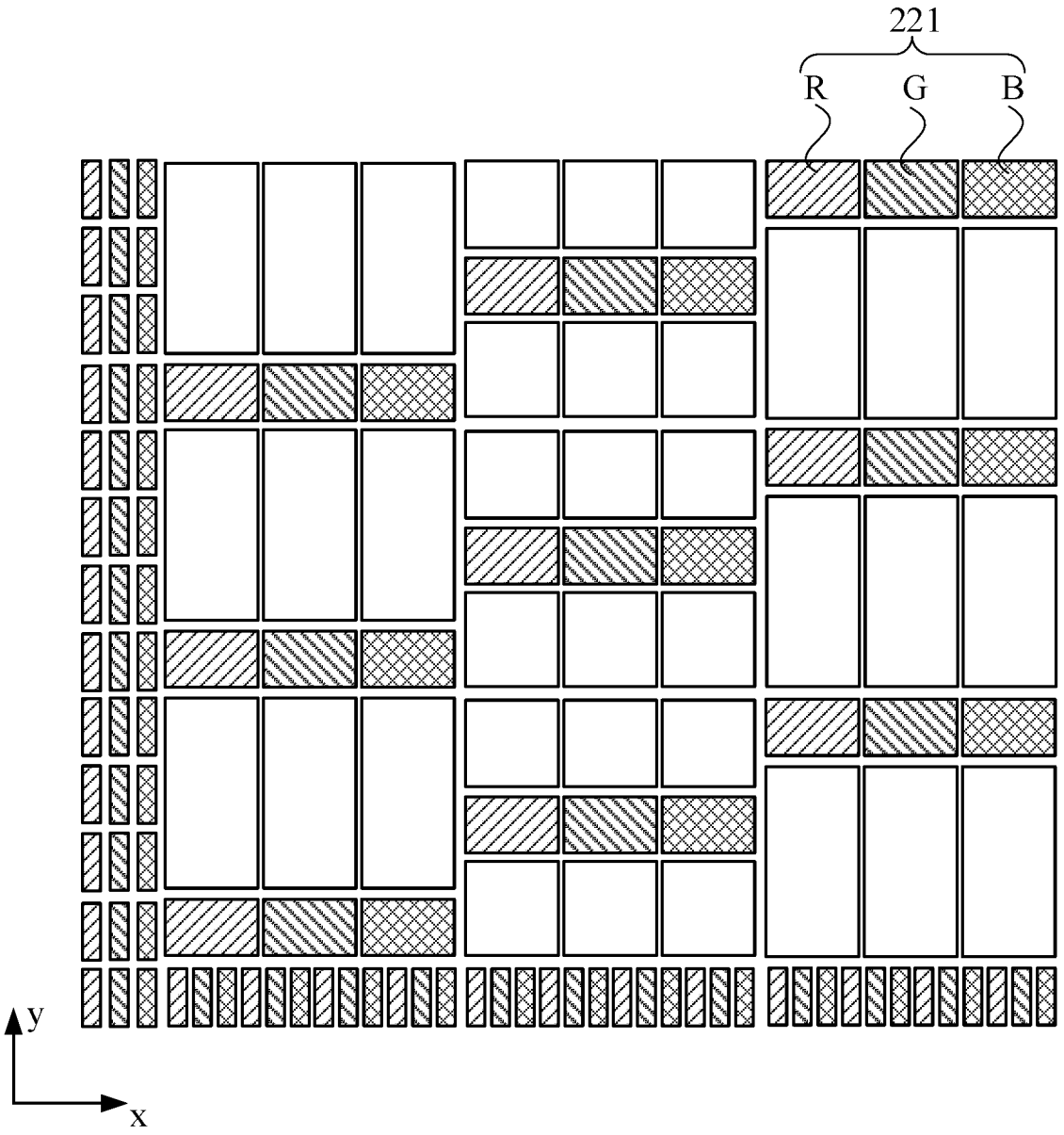

Exemplarily, like a setting of pixels in the second display area in FIG. 3, FIGS. 6-8 illustrate partial schematic diagrams of another exemplary display panel consistent with various disclosed embodiments of the present disclosure. Referring to FIGS. 6-8, the plurality of second sub-pixels 221 includes red sub-pixels R, green sub-pixels G, and blue sub-pixels B. Referring to FIG. 6, in a same second pixel, red sub-pixels R, green sub-pixels G, and blue sub-pixel B are arranged in sequence along a row direction. Positions of the three sub-pixels in the second pixel are different, and they are respectively located at a top or bottom of the second pixel. Referring to FIGS. 7-8, positions of red sub-pixels R, green sub-pixels G, and blue sub-pixels B in a second pixel in a same column are the same. Positions of red sub-pixel R, green sub-pixel G, and blue sub-pixel B in second pixels of adjacent columns are different in the second pixel. The setting can reduce raster effect of white sub-pixels and improve imaging effect of the camera.

FIGS. 6-8 are only a few schematic pixel settings provided by the embodiments of the present disclosure. The few settings can also be combined to form more settings, which are also within the protection scope of the embodiments of the present disclosure.

Optionally, a length of the second area in the first direction changes non-periodically, and/or a length of the second area in the second direction changes non-periodically.

When the camera is in operation, the white sub-pixels in the second area form light-transmitting areas. The red sub-pixels, green sub-pixels, and blue sub-pixels in the first area form non-light-transmitting areas. When the light-transmitting areas and the non-light-transmitting areas are arranged at intervals, a grating structure is formed. When light is transmitted through the light-transmitting areas, multi-order diffraction fringes are formed, which affects imaging effect of the camera. Therefore, a size of the second area can be set to change non-periodically along a row direction and/or a column direction, which can reduce diffraction of light in the transparent area and improve imaging effect of the camera.

Figure 9:
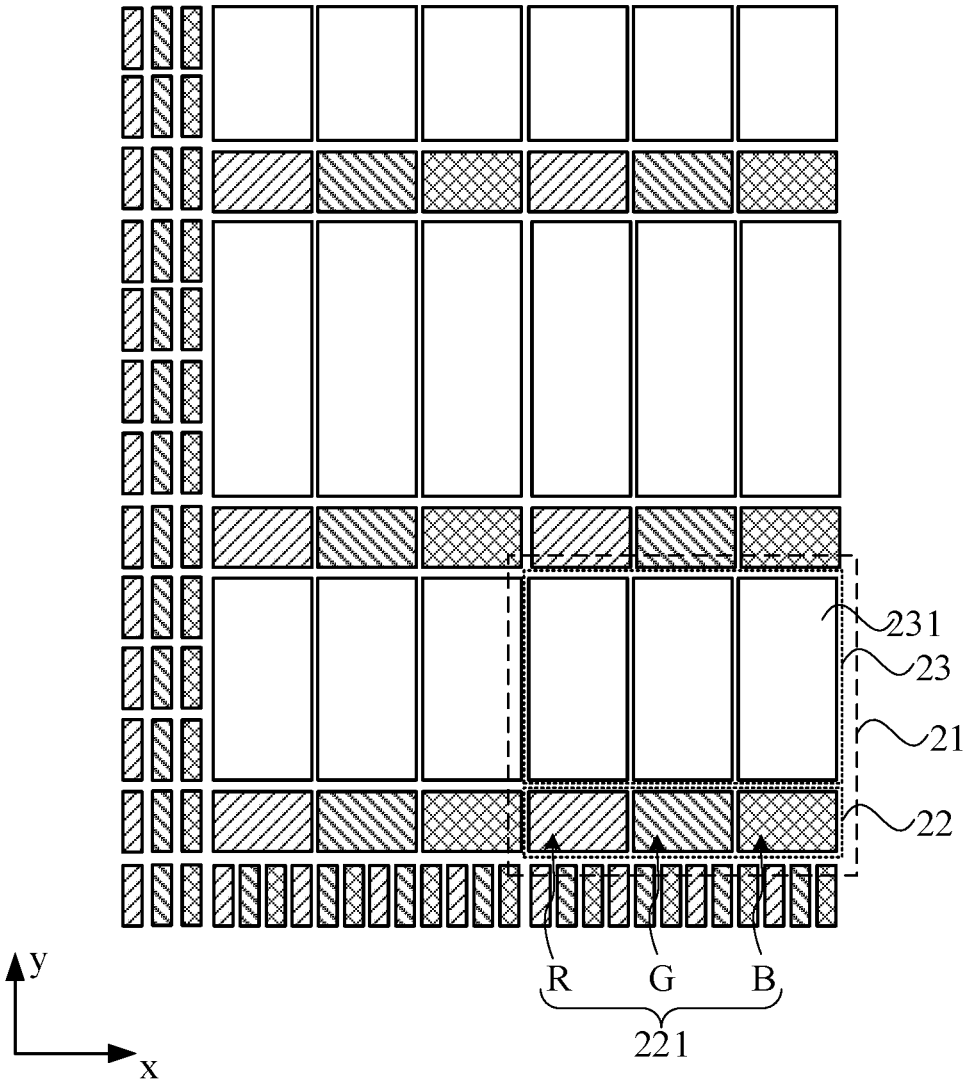
FIG. 9 illustrates a partial schematic diagram of another exemplary display panel consistent with various disclosed embodiments of the present disclosure.

Exemplarily, [0014] FIG. 9 illustrates a partial schematic diagram of another exemplary display panel consistent with various disclosed embodiments of the present disclosure. In one embodiment shown in FIG. 9, a length of the second area 23 in the second direction y changes non-periodically, so that diffraction phenomenon can be reduced.

Optionally, in a display panel in one embodiment, first sub-pixels in first pixels and the second sub-pixels in second pixels synchronously display pictures, thereby realizing synchronous display of a first display area and a second display area. avoid designing a separate driving circuit for the second display area and simplifying cost of display panel design.

Optionally, a second area includes pixel electrodes. A second display area also includes a conductive metal layer. The conductive metal layer is electrically connected to all of the pixel electrodes in the second area, and is configured to control the second area to be in an open state when a photosensitive element is in operation, and to control the second area to be in a closed state when a display panel is in a full screen display.

Figure 10:
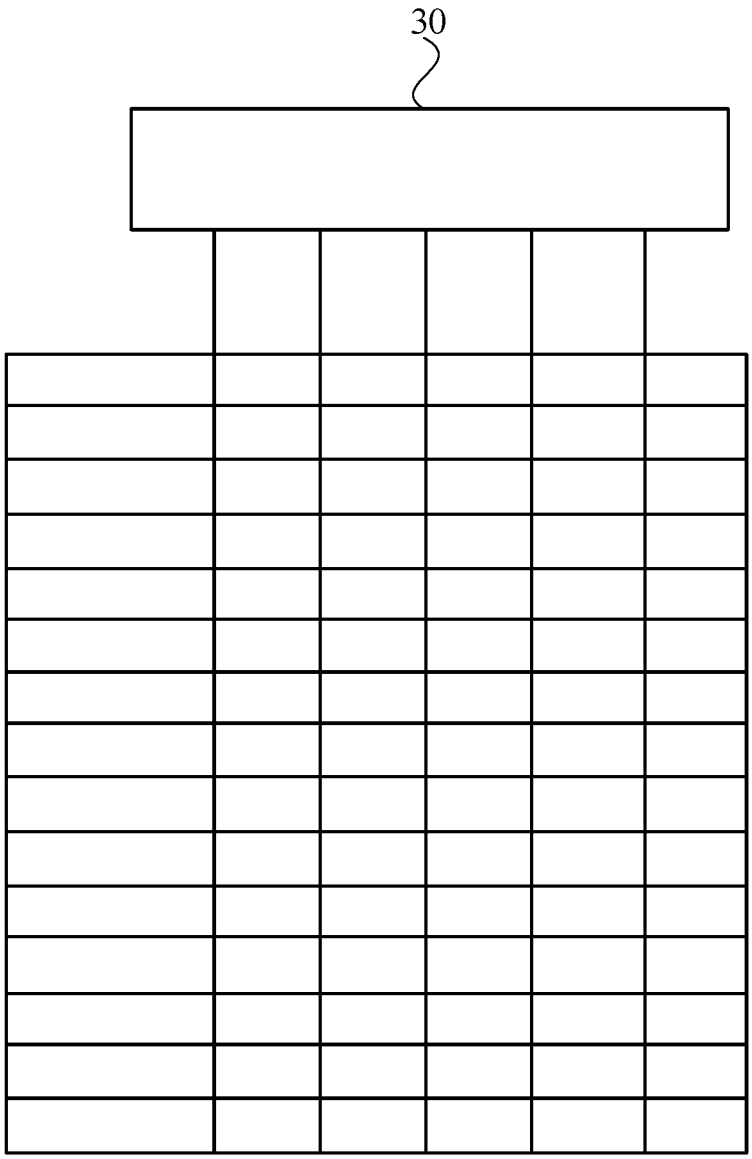
FIG. 10 illustrates a schematic diagram of a conductive metal layer consistent with various disclosed embodiments of the present disclosure.

Each sub-pixel in a liquid crystal display panel has a corresponding pixel electrode and a common electrode. Different voltages are applied to pixel electrodes through a pixel circuit to control deflections of liquid crystal molecules to achieve different grayscale displays. In order to simplify structure of a display panel, a second area may not be provided with a pixel circuit, and all of the pixel electrodes corresponding to the second area are connected by a conductive metal layer, so that all white sub-pixels in the second pixel in a same row are regarded as same sub-pixels. An overall control of the white sub-pixels in all rows, only includes two states of on (transparent) and off (opaque), thus simplifying a control method of a second display area. Exemplarily, FIG. 10 illustrates a schematic diagram of a conductive metal layer consistent with various disclosed embodiments of the present disclosure. Pixel electrodes in second areas of second pixels in each row are connected by a line in a row direction. A plurality of lines connected to a frame area control circuits 30 are arranged in a column direction to realize an overall control of all the second area.

Optionally, a first pixel includes first sub-pixel circuits corresponding to first sub-pixels. The first sub-pixel circuits are configured to control the first sub-pixels to emit light. A second pixel includes second sub-pixel circuits corresponding to the second sub-pixels. The second sub-pixels are configured to control the second sub-pixels to emit light. The second pixels also include third sub-pixel circuits corresponding to a second area. The third sub-pixel circuits are configured to control light transmittance of the second area according to light output brightness of the second sub-pixels.

Figure 11:
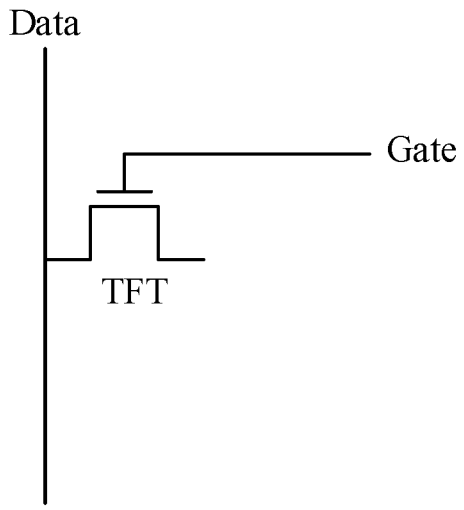
FIG. 11 illustrates a schematic diagram of a principle of a pixel circuit consistent with various disclosed embodiments of the present disclosure.

Exemplarily, FIG. 11 illustrates a schematic diagram of a principle of a pixel circuit consistent with various disclosed embodiments of the present disclosure. Referring to FIG. 11, the pixel circuit includes a thin film transistor TFT. A gate of the TFT is connected to a scanning signal line Gate. A source of the TFT is connected to a data signal line Data. A drain of the TFT is connected to a pixel electrode (not shown). The scanning signal line Gate controls turn-on and turn-off of the TFT. The data signal line Data applies a voltage that controls deflections of the liquid crystal to pixel electrodes to achieve different gray scale displays. A first sub-pixel circuit and a second sub-pixel circuit respectively control light-emitting brightness of first sub-pixels and second sub-pixels. By arranging the third sub-pixel circuits in the second area, the second area can include a plurality of gray-scale states corresponding to the second sub-pixels, which is beneficial to improve display effect of the second display area.

When pixel circuits are also designed in the second area, in existing designs, a larger area matrix need to be designed to shield the pixel circuits and metal traces, resulting in a decrease in pixel aperture ratio and a smaller light-transmitting area formed in the second area. Therefore, the present disclosure also improves pixel circuit structure and matrix shape to increase aperture ratio.

Optionally, in two adjacent second pixels, second sub-pixel circuits of two adjacent second sub-pixels are arranged adjacently and aligned along a third direction. Or a second sub-pixel circuit of the adjacent second sub-pixels and a third sub-pixel circuit of a second area are arranged adjacently and aligned along a third direction. The third direction is parallel to a column direction or row direction of a second. A display panel also includes light-shielding layers. A projection of a light-shielding layer on a plane where the display panel is located completely covers the second sub-pixel circuit and the third sub-pixel circuit.

Figure 12:
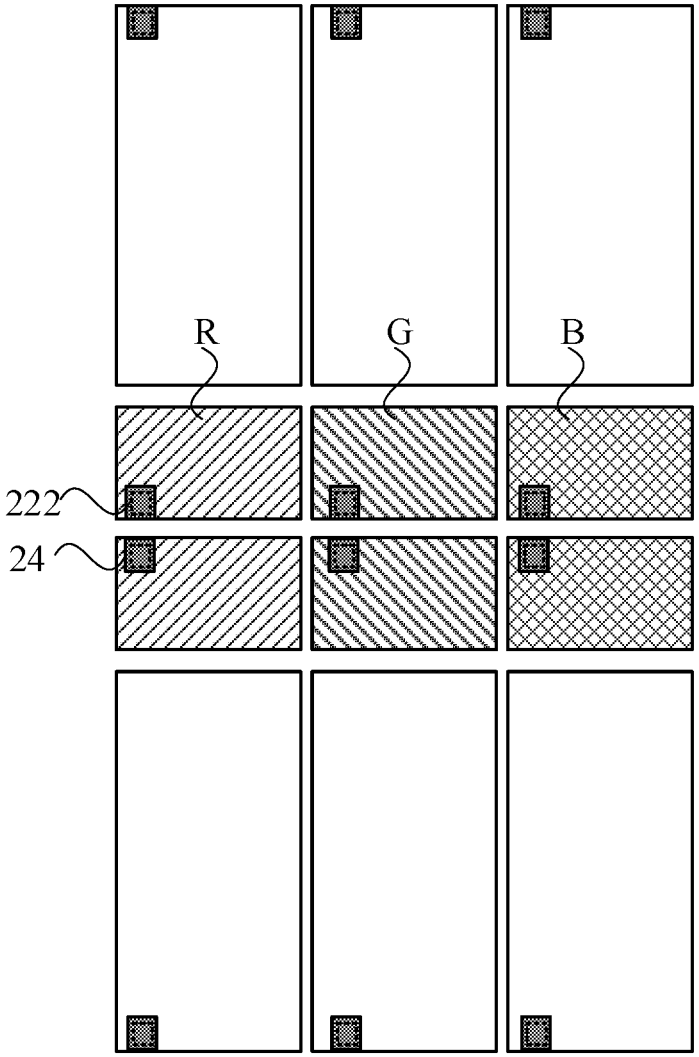
FIGS. 12-13 illustrate partial schematic diagrams of a second display area consistent with various disclosed embodiments of the present disclosure.
Figure 13:
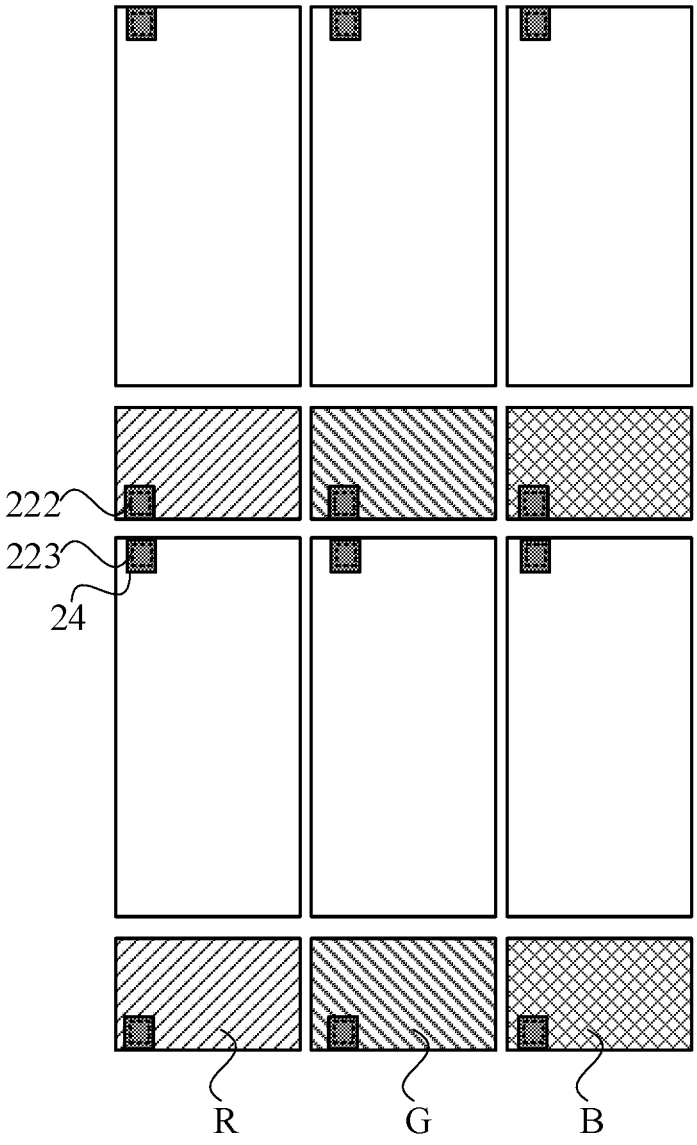

Exemplarily, FIGS. 12-13 illustrate partial schematic diagrams of a second display area consistent with various disclosed embodiments of the present disclosure. Referring to FIG. 12, second sub-pixel circuits 222 corresponding to two adjacent red sub-pixels R, two adjacent green sub-pixels G, and two adjacent blue sub-pixels B are respectively arranged adjacently and aligned along a column direction. Referring to FIG. 13, a second sub-pixel circuit 222 corresponding to a second sub-pixel (red sub-pixel R, green sub-pixel G or blue sub-pixel B) and a third sub-pixel circuit 223 corresponding to an adjacent white sub-pixel W arranged adjacently and aligned along a column direction. Referring to FIGS. 12-13, the display panel also includes light-shielding layers 24. A projection of a light-shielding layer 24 on a plane where the display panel is located completely covers the second sub-pixel circuit 222 and the third sub-pixel circuit 223. In other embodiments, two adjacent sub-pixel circuits may also be aligned in a row direction.

Optionally, a distance between an edge of the light-shielding layer and an edge of a corresponding sub-pixel circuit is less than or equal to 2 μm.

By setting the distance between an edge of the light-shielding layer and an edge of the corresponding sub-pixel circuit to be less than or equal to 2 μm, it can not only ensure that the light-shielding layer completely shields corresponding sub-pixels, but also ensure a smaller light-shielding layer area and improve aperture ratio of the second display area.

In one embodiment, pixel circuits of two adjacent color sub-pixels or adjacent one color sub-pixel and one white sub-pixel are aligned in a row direction or a column direction, so as to share a light-shielding layer with a smaller area and avoid making the light-shielding layer into a whole shape to reduce aperture ratio. In other embodiments, pixel circuits of two adjacent white sub-pixels may be aligned in a row direction or a column direction. In a specific implementation, the pixel circuits can be designed according to an actual structure.

Optionally, a second sub-pixel circuit and a third sub-pixel circuits both include thin film transistors. A distance between active layers of the thin film transistors in two adjacent sub-pixel circuits is 2 μm to 3 μm.

Figure 14:
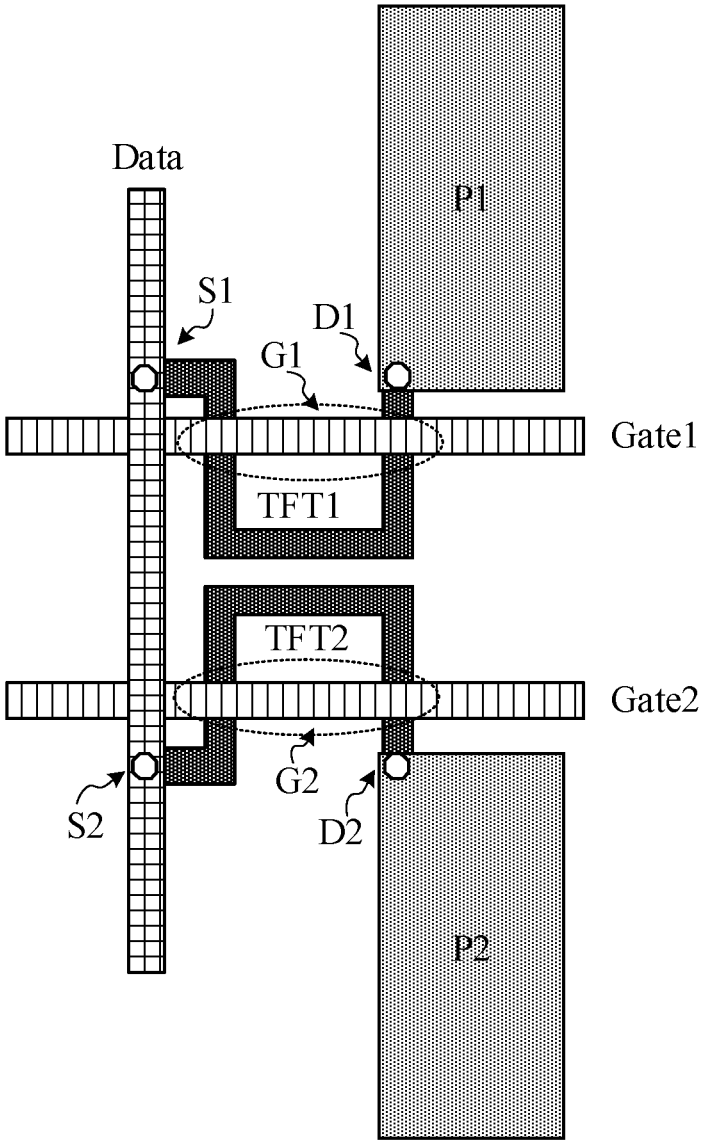
FIG. 14 illustrates a schematic diagram of a pixel circuit consistent with various disclosed embodiments of the present disclosure.

Exemplarily, FIG. 14 illustrates a schematic diagram of a pixel circuit consistent with various disclosed embodiments of the present disclosure. Referring to FIG. 14, a second sub-pixel circuit includes a first thin film transistor TFT1. The first thin film transistor TFT1 includes a gate G1, a source S1, and a drain D1. The gate G1 of TFT1 is connected to a scanning signal line Gate1. The source S1 of TFT1 is connected to a data signal line Data. The drain D1 of TFT1 is connected to a pixel electrode P1 of the second sub-pixel. A third sub-pixel circuit includes a second thin film transistor TFT2. The second thin film transistor TFT2 includes a gate G2, a source S2, and a drain D2. The gate G2 of TFT2 is connected to a scanning signal line Gate2. The source S2 of TFT2 is connected to the data signal line Data. The drain D2 of TFT2 is connected to a pixel electrode P2 of the second sub-pixel. Since the two transistors are arranged in alignment, to avoid short circuits between active layers, a distance between the active layers of the two transistors can be set to 2 μm~3 μm.

A structure of two second sub-pixel circuits aligned in a row direction or column direction is a same as a structure shown in FIG. 14.

Optionally, in two adjacent second pixels, second sub-pixel circuits of two adjacent second sub-pixels are arranged adjacently and are misaligned along a third direction. Or a second sub-pixel circuit of the adjacent second sub-pixels and a third sub-pixel circuit of a second area are arranged adjacently and is misaligned along the third direction. The third direction is parallel to a column direction or row direction of a second pixel array. A display panel also includes light-shielding layers. A projection of a light-shielding layer on a plane where the display panel is located completely covers the second sub-pixel circuit and the third sub-pixel circuit.

Figure 15:
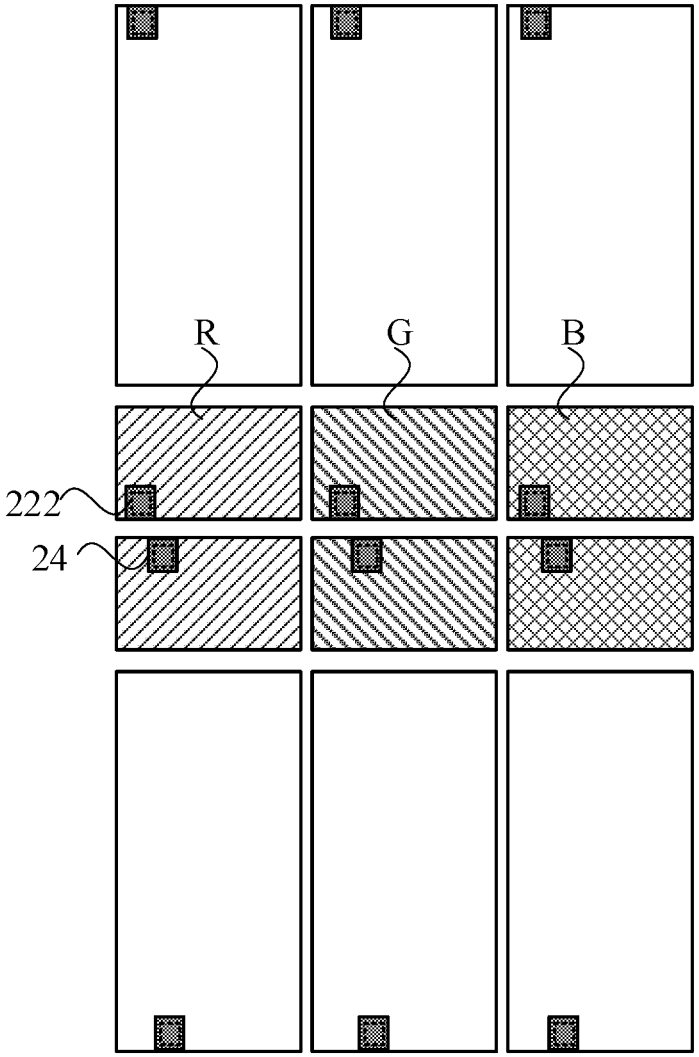
FIGS. 15-16 illustrate partial schematic diagrams of another second display area consistent with various disclosed embodiments of the present disclosure.
Figure 16:
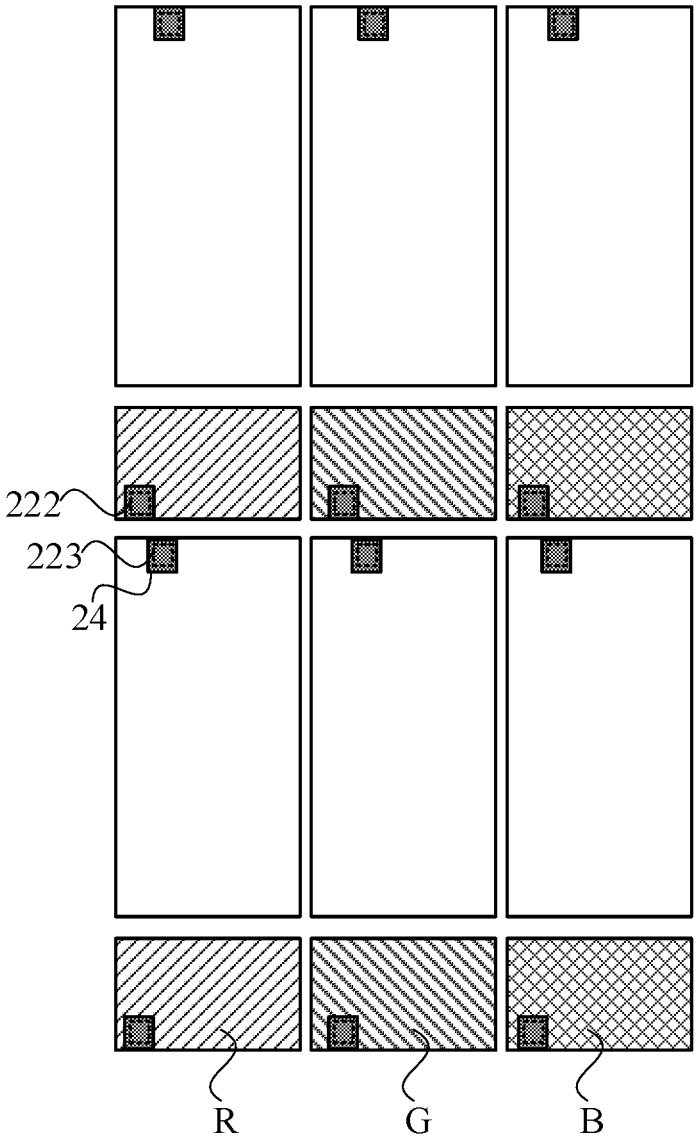

Exemplarily, FIGS. 15-16 illustrate partial schematic diagrams of another second display area consistent with various disclosed embodiments of the present disclosure. Referring to FIG. 15, second sub-pixel circuits 222 corresponding to two adjacent red sub-pixels R, two adjacent green sub-pixels G, and two adjacent blue sub-pixels B are respectively arranged adjacently and are staggered along a column direction. Referring to FIG. 16, a second sub-pixel circuit 222 corresponding to a second sub-pixel (red sub-pixel R or green sub-pixel G or blue sub-pixel B) and a third sub-pixel circuit 223 corresponding to an adjacent white sub-pixel W are arranged adjacently and are staggered along a row direction. Referring to FIGS. 15-16, The display panel also includes light-shielding layers 24. A projection of a light-shielding layer 24 on a plane where the display panel is located completely covers the second sub-pixel circuit 222 and the third sub-pixel circuit 223. In other embodiments, two adjacent sub-pixel circuits can also be staggered in a row direction.

Optionally, a second sub-pixel circuit and a third sub-pixel circuit both include thin film transistors. A distance between active layers of the thin film transistors in two adjacent sub-pixel circuits is 1.5 μm to 2.5 μm.

Figure 17:
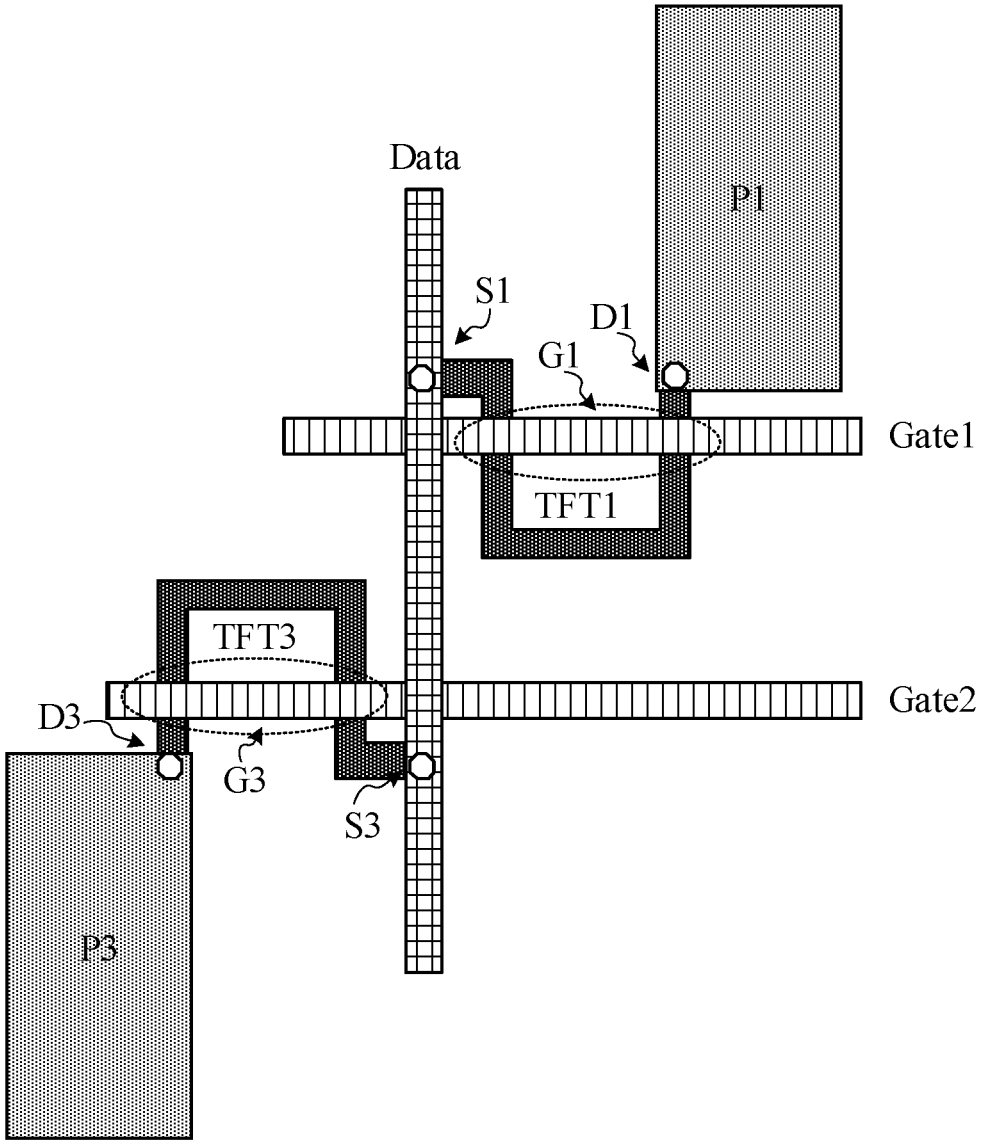
FIG. 17 illustrates a schematic diagram of another pixel circuit consistent with various disclosed embodiments of the present disclosure.

FIG. 17 illustrates a schematic diagram of another pixel circuit consistent with various disclosed embodiments of the present disclosure. Referring to FIG. 17, a second sub-pixel circuit includes a first thin film transistor TFT1. A third sub-pixel circuit includes a thin film transistor TFT3. Basic structure of the pixel circuit is like a structure shown in FIG. 14. Due to misalignment of the two transistors, compared to a pixel circuit shown in FIG. 14, a distance between active layers can be smaller. The distance between the active layers of the two transistors can be set to 1.5 μm~2.5 μm.

A structure of two second sub-pixel circuits that staggered in a row direction or a column direction is a same as a structure shown in FIG. 17.

Figure 18:
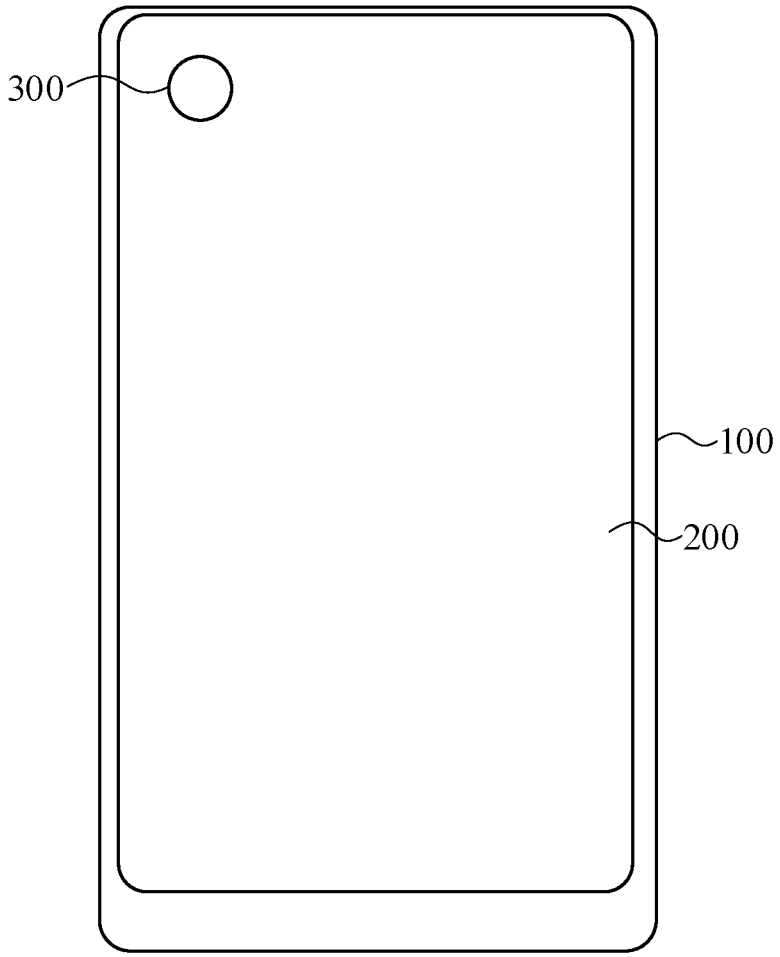
FIG. 18 illustrates a schematic diagram of a display device consistent with various disclosed embodiments of the present disclosure.

FIG. 18 illustrates a schematic diagram of a display device consistent with various disclosed embodiments of the present disclosure. Referring to FIG. 18, the display device 100 includes any display panel 200 provided by an embodiment of the present disclosure. The display device further includes a photosensitive element 300 in a second display area of the display panel and on a side away from a light emitting surface of the display panel 200. A photosensitive surface of the photosensitive element 300 faces the display panel. The display device 100 may specifically be a mobile phone, a tablet computer, etc.

Optionally, the photosensitive element 300 may be a camera or a plurality of cameras arranged in an array. Since the display device includes any display panel provided by the above embodiments, it has a same and corresponding technical effect of the display panel.

The above are only preferred embodiments of the present disclosure and applied technical principles. The present disclosure is not limited to the specific embodiments described herein. Those skilled in the art can make various obvious changes, re-adjustments, and substitutions without departing from the protection scope of the present disclosure. Although the present disclosure has been described in detail through the above embodiments, the present disclosure is not only limited to the above embodiments and may include other equivalent embodiments without departing from concepts of the present disclosure. The scope of the present disclosure is determined by the scope of the appended claims.

What is claimed is:

1. A display panel, comprising:

a first display area and a second display area adjacent to the first display area, the second display area being multiplexed as a photosensitive element setting area, the first display area including a plurality of first pixels arranged in an array, and the second display area including a plurality of second pixels arranged in an array, wherein:

a first pixel of the plurality of first pixels includes a plurality of first sub-pixels, a second pixel of the plurality of second pixels includes a first area and a second area, the first area includes a plurality of second sub-pixels, an area of a first sub-pixel of the plurality of first sub-pixels is less than an area of a second sub-pixel of the plurality of second sub-pixels, and an area of the first area is less than or equal to an area of the second area, the second area is in an open state when a photosensitive element is in operation, and external light enters the photosensitive element through the second area, and the second area is in a closed state when the display panel is in a full screen display, and the plurality of second sub-pixels are configured to realize a normal display of the second display area.

2. The display panel according to claim 1, wherein:

the plurality of second sub-pixels include red sub-pixels, green sub-pixels, and blue sub-pixels, the second area includes a plurality of first sub-areas corresponding to the plurality of second sub-pixels in a one-to-one correspondence;

along a first direction, the red sub-pixels, the green sub-pixels, and the blue sub-pixels are repeatedly arranged in sequence; and along a second direction interacting the first direction, the plurality of second sub-pixels and the plurality of first sub-areas are alternately arranged.

3. The display panel according to claim 1, wherein:

the plurality of second sub-pixels include red sub-pixels, green sub-pixels, and blue sub-pixels, the second area includes a plurality of second sub-areas corresponding to the plurality of second sub-pixels in a one-to-one correspondence;

along a first direction, the red sub-pixels, the green sub-pixels, and the blue sub-pixels are repeatedly arranged, and the plurality of second sub-pixels and the plurality of second sub-areas are arranged at intervals in sequence; and along a second direction interacting the first direction, light outputted from the plurality of second sub-pixels have a same color.

4. The display panel according to claim 1, wherein:

the plurality of second sub-pixels include red sub-pixels, green sub-pixels, and blue sub-pixels;

along a first direction, the red sub-pixels, the green sub-pixels, and the blue sub-pixels are arranged repeatedly in sequence, red sub-pixels, green sub-pixels, and blue sub-pixels in a same second pixel form a sub-pixel unit, and the sub-pixel unit and the second area are alternately arranged; and along a second direction interacting the first direction, light outputted from the plurality of second sub-pixels have a same color.

5. The display panel according to claim 1, wherein:

the plurality of second sub-pixels include red sub-pixels, green sub-pixels, and blue sub-pixels; and in two adjacently arranged second pixels, positions of the first areas in the two adjacently arranged second pixels are different.

6. The display panel according to claim 1, wherein the second area includes white sub-pixels.

7. The display panel according to claim 1, wherein the plurality of first sub-pixels in the first pixel and plurality of second sub-pixels in the second pixel synchronously display a screen.

8. The display panel according to claim 1, wherein:

the second area includes pixel electrodes; and the second display area further includes a conductive metal layer, the conductive metal layer is electrically connected to all of the pixel electrodes of the second area, and is configured to control the second area to be in the open state when the photosensitive element is in operation, and to control the second area to be in the closed state when the display panel is in the full screen display.

9. The display panel according to claim 1, wherein:

the first pixel includes a first sub-pixel circuit corresponding to the plurality of first sub-pixels, and the first sub-pixel circuit is configured to control the plurality of first sub-pixels to emit light;

the second pixel includes a second sub-pixel circuit corresponding to the plurality of second sub-pixels, and the second sub-pixel circuit is configured to control the plurality of second sub-pixels to emit light; and the second pixel further includes a third sub-pixel circuit corresponding to the second area, and the third sub-pixel circuit is configured to control a light transmission of the second area according to a light output brightness of the plurality of second sub-pixels.

10. The display panel according to claim 9, wherein:

in two adjacent second pixels, second sub-pixel circuits of the two adjacent second sub-pixels are arranged adjacently and aligned along a third direction, or a second sub-pixel circuit of the adjacent second sub-pixels and a third sub-pixel circuit of the second area are arranged adjacently and aligned along the third direction, wherein the third direction is parallel to a column direction or a row direction of the array of the plurality of second pixels; and the display panel further includes light-shielding layers, a projection of a light-shielding layer on a plane where the display panel is located completely covers the second sub-pixel circuit and the third sub-pixel circuit.

11. The display panel according to claim 10, wherein the second sub-pixel circuit and the third sub-pixel circuit both include thin film transistors, and a distance between active layers of the thin film transistors in two adjacent sub-pixel circuits is 2 μm to 3 μm.

12. The display panel according to claim 9, wherein:

in two adjacent second pixels, second sub-pixel circuits of the two adjacent second sub-pixels are arranged adjacently and misaligned along a third direction, or a second sub-pixel circuit of the adjacent second sub-pixels and a third sub-pixel circuit of the second area are arranged adjacently and misaligned along the third direction, wherein the third direction is parallel to a column direction or a row direction of the array of the plurality of second pixels; and the display panel further includes light-shielding layers, a projection of a light-shielding layer on a plane where the display panel is located completely covers the second sub-pixel circuit and the third sub-pixel circuit.

13. The display panel according to claim 12, wherein the second sub-pixel circuit and the third sub-pixel circuit both include thin film transistors, and a distance between active layers of the thin film transistors in two adjacent sub-pixel circuits is 1.5 μm to 2.5 μm.

14. The display panel according to claim 10, wherein a distance between an edge of the light-shielding layer and an edge of a corresponding sub-pixel circuit is less than or equal to 2 μm.

15. The display panel according to claim 2, wherein a length of the second area in the first direction changes non-periodically, and/or the length of the second area in the second direction changes non-periodically.

16. The display panel according to claim 1, wherein an area ratio of the second area to the first area is greater than or equal to 2, and less than or equal to 4.

17. The display panel according to claim 1, wherein an area of the second sub-pixel is a same as an area of n first sub-pixels, and n is an integer greater than or equal to 2.

18. A display device, comprising:

a display panel including a first display area and a second display area adjacent to the first display area, the second display area being multiplexed as a photosensitive element setting area, the first display area including a plurality of first pixels arranged in an array, and the second display area including a plurality of second pixels arranged in an array, wherein:

a first pixel of the plurality of first pixels includes a plurality of first sub-pixels, a second pixel of the plurality of second pixels includes a first area and a second area, the first area includes a plurality of second sub-pixels, an area of a first sub-pixel of the plurality of first sub-pixels is less than an area of a second sub-pixel of the plurality of second sub-pixels, and an area of the first area is less than or equal to an area of the second area, the second area is in an open state when a photosensitive element is in operation, and external light enters the photosensitive element through the second area, and the second area is in a closed state when the display panel is in a full screen display, and the plurality of second sub-pixels are configured to realize a normal display of the second display area, and a photosensitive element, disposed in the second display area of the display panel and on a side away from a light emitting surface of the display panel, a photosensitive surface of the photosensitive element facing toward the display panel.

19. The display device according to claim 18, wherein the photosensitive element includes a camera, or a plurality of cameras arranged in an array.

* * * * *